US011118440B2

(12) United States Patent
Wilson et al.

(10) Patent No.: US 11,118,440 B2
(45) Date of Patent: Sep. 14, 2021

(54) METHOD, SYSTEM AND COMPUTER-READABLE MEDIUM FOR AUTOMATICALLY CONTROLLING A DRILLING OPERATION

(71) Applicant: PASON SYSTEMS CORP., Calgary (CA)

(72) Inventors: Thomas William Charles Wilson, Calgary (CA); Adam Chase Neufeldt, Calgary (CA); Ernest Wade Harrison, Calgary (CA); Sean William Scotvold, Calgary (CA)

(73) Assignee: PASON SYSTEMS CORP., Calgary (CA)

( * ) Notice: Subject to any disclaimer, the term of this patent is extended or adjusted under 35 U.S.C. 154(b) by 366 days.

(21) Appl. No.: 16/023,117

(22) Filed: Jun. 29, 2018

(65) Prior Publication Data

US 2019/0032466 A1 Jan. 31, 2019

(30) Foreign Application Priority Data

Jul. 28, 2017 (CA) ..... CA 2975051

(51) Int. Cl.

| | |
|---|---|
| ***E21B 44/00*** | (2006.01) |
| ***E21B 3/02*** | (2006.01) |
| ***E21B 21/08*** | (2006.01) |
| ***E21B 19/00*** | (2006.01) |
| *E21B 7/04* | (2006.01) |
| *E21B 45/00* | (2006.01) |

(52) U.S. Cl.

CPC ..... *E21B 44/00* (2013.01); *E21B 3/02* (2013.01); *E21B 19/008* (2013.01); *E21B 21/08* (2013.01); *E21B 7/04* (2013.01); *E21B 45/00* (2013.01)

(58) Field of Classification Search

CPC ..... E21B 44/00; E21B 19/008; E21B 21/08; E21B 3/02; E21B 45/00; E21B 7/04

See application file for complete search history.

(56) References Cited

U.S. PATENT DOCUMENTS

2009/0090555 A1* 4/2009 Boone ..... E21B 44/02 175/45
2017/0328193 A1* 11/2017 Holt ..... G01V 3/00
2018/0058187 A1* 3/2018 Magnuson ..... E21B 21/08

(Continued)

*Primary Examiner* — Michael R Wills, III
(74) *Attorney, Agent, or Firm* — Katten Muchin Rosenman LLP

(57) ABSTRACT

There is described a method for automatically controlling a drilling operation. The method comprises obtaining a recording of one or more controlled drilling parameters adjusted, during a first drilling operation, in response to one or more controlling drilling parameters. The method further comprises, during a second drilling operation subsequent to the first drilling operation, monitoring the one or more controlling drilling parameters. The method further comprises, during the second drilling operation, automatically adjusting the one or more controlled drilling parameters in response to the monitored one or more controlling drilling parameters by using the recording of the one or more controlled drilling parameters. Thus, by recording a driller's instructions once (during a recording phase) and automatically replaying them during successive playback phases, drilling is made more efficient and simpler.

29 Claims, 10 Drawing Sheets

(56) References Cited

U.S. PATENT DOCUMENTS

| | | | | |
|---|---|---|---|---|
| 2018/0106133 | A1* | 4/2018 | Bolchover | E21B 41/0092 |
| 2018/0283158 | A1* | 10/2018 | Hadi | E21B 47/06 |
| 2018/0328164 | A1* | 11/2018 | Gajic | E21B 7/068 |

* cited by examiner

| Block Position | Time | Differential Pressure | Toolface | WOB SP | DIFP SP | ROP SP | Torque SP | Oscillator SP | RPM SP | Slide RPM SP | Top Position SP | Off Bottom ROP SP | Left Turns SP | Right Turns SP |
|---|---|---|---|---|---|---|---|---|---|---|---|---|---|---|
| -90.0845 | 0 | 0 | 72.8 | 0 | 0 | 20 | 900 | FALSE | 0 | 20 | 140.0625 | 100 | 1 | 1 |
| -90.0858 | 8.478447 | 0 | 72.6 | 5 | 0 | 20 | 900 | FALSE | 0 | 20 | 140.0625 | 100 | 1 | 1 |
| -90.1975 | 49.37777 | 4.69 | 72.11 | 5 | 500 | 20 | 900 | FALSE | 0 | 20 | 140.0625 | 100 | 1 | 1 |
| -90.2118 | 53.46356 | 330.14 | 72.3 | 5 | 500 | 20 | 900 | FALSE | 0 | 20 | 860.0625 | 100 | 1 | 1 |
| -90.2865 | 74.55877 | 418.01 | 229.53 | 5 | 800 | 20 | 900 | FALSE | 0 | 20 | 860.0625 | 100 | 1 | 1 |
| -90.3056 | 79.69665 | 431.42 | 341.98 | 7 | 800 | 20 | 900 | FALSE | 0 | 20 | 860.0625 | 100 | 1 | 1 |
| -90.3884 | 98.6266 | 651.55 | 340.22 | 7 | 800 | 20 | 900 | FALSE | 0 | 20 | 920.0625 | 100 | 1 | 1 |
| -90.4241 | 106.4184 | 671.88 | 358.73 | 7 | 800 | 20 | 900 | FALSE | 0 | 20 | 980.0625 | 100 | 1 | 1 |
| -90.462 | 114.6843 | 681.11 | 358.73 | 10 | 800 | 20 | 900 | FALSE | 0 | 20 | 980.0625 | 100 | 1 | 1 |
| -90.4854 | 119.6151 | 733.06 | 359.82 | 10 | 800 | 20 | 900 | FALSE | 0 | 20 | 1040.063 | 100 | 1 | 1 |
| -90.4893 | 120.3189 | 767.17 | 5.45 | 10 | 800 | 20 | 900 | FALSE | 0 | 20 | 1100.063 | 100 | 1 | 1 |
| -90.5566 | 133.9681 | 772.42 | 90.57 | 10 | 800 | 25 | 900 | FALSE | 0 | 20 | 1100.063 | 100 | 1 | 1 |
| -90.5744 | 137.52 | 779.16 | 90.53 | 10 | 1000 | 25 | 900 | FALSE | 0 | 20 | 1100.063 | 100 | 1 | 1 |
| -90.7259 | 167.4235 | 831.14 | 90 | 10 | 1000 | 25 | 900 | FALSE | 0 | 20 | 1160.063 | 100 | 1 | 1 |
| -90.8454 | 189.9435 | 910.87 | 101.07 | 10 | 1200 | 25 | 900 | FALSE | 0 | 20 | 1160.063 | 100 | 1 | 1 |
| -90.9003 | 199.9297 | 954.64 | 100.85 | 13 | 1200 | 25 | 900 | FALSE | 0 | 20 | 1160.063 | 100 | 1 | 1 |
| -91.0489 | 225.1926 | 1071.75 | 98.53 | 13 | 1500 | 25 | 900 | FALSE | 0 | 20 | 1160.063 | 100 | 1 | 1 |
| -91.067 | 228.1987 | 1117.67 | 120.23 | 13 | 1500 | 25 | 900 | TRUE | 0 | 20 | 1160.063 | 100 | 1 | 1 |
| -91.1196 | 236.8131 | 1171.61 | 63.68 | 13 | 1500 | 25 | 900 | TRUE | 0 | 20 | 1100.063 | 100 | 1 | 1 |
| -91.1307 | 238.5117 | 1175.58 | 44.25 | 13 | 1500 | 25 | 900 | TRUE | 0 | 20 | 1040.063 | 100 | 1 | 1 |
| -91.1344 | 239.125 | 1174.24 | 44.25 | 13 | 1500 | 25 | 900 | TRUE | 0 | 20 | 980.0625 | 100 | 1 | 1 |
| -91.1556 | 242.5674 | 1185.82 | 44.25 | 13 | 1500 | 25 | 900 | TRUE | 0 | 20 | 920.0625 | 100 | 1 | 1 |
| -91.1756 | 245.7847 | 1200.57 | 47.02 | 13 | 1500 | 25 | 900 | TRUE | 0 | 20 | 980.0625 | 100 | 1 | 1 |
| -91.2559 | 258.6021 | 1278.28 | 46.54 | 15 | 1500 | 25 | 900 | TRUE | 0 | 20 | 980.0625 | 100 | 1 | 1 |
| -91.2898 | 263.7396 | 1328.31 | 44.82 | 15 | 1500 | 30 | 900 | TRUE | 0 | 20 | 980.0625 | 100 | 1 | 1 |
| -91.4382 | 285.7158 | 1338.75 | 43.59 | 17 | 1500 | 30 | 900 | TRUE | 0 | 20 | 980.0625 | 100 | 1 | 1 |
| -91.4759 | 291.1534 | 1373.97 | 43.55 | 17 | 1500 | 30 | 900 | TRUE | 0 | 20 | 1010.063 | 100 | 1 | 1 |
| -91.4815 | 292.0518 | 1435.25 | 43.46 | 17 | 1500 | 30 | 900 | TRUE | 0 | 20 | 1040.063 | 100 | 1 | 1 |
| -91.4997 | 294.6275 | 1448.24 | 43.59 | 17 | 1500 | 30 | 900 | TRUE | 0 | 20 | 1070.063 | 100 | 1 | 1 |
| -91.6835 | 320.5934 | 1454.03 | 44.08 | 17 | 1700 | 30 | 900 | TRUE | 0 | 20 | 1070.063 | 100 | 1 | 1 |

FIG. 5

| Block Position | Time | Differential Pressure | Toolface | WOB SP | DIFP SP | ROP SP | Torque SP | Oscillator SP | RPM SP | Slide RPM SP | Top Position SP | Off Bottom ROP SP | Left Turns SP | Right Turns SP |
|---|---|---|---|---|---|---|---|---|---|---|---|---|---|---|
| -25.1545 | 0 | 0 | 338.28 | 0 | 0 | 30 | 900 | FALSE | 0 | 50 | 126.9492 | 100 | 1.75 | 1.75 |
| -25.1553 | 5.088845 | 0 | 338.28 | 0 | 0 | 30 | 900 | FALSE | 30 | 50 | 126.9492 | 100 | 1.75 | 1.75 |
| -25.1566 | 11.19435 | 33.55 | 151.61 | 10 | 0 | 30 | 900 | FALSE | 30 | 50 | 126.9492 | 100 | 1.75 | 1.75 |
| -25.4094 | 71.3514 | 906.63 | 11.92 | 10 | 0 | 30 | 900 | FALSE | 60 | 50 | 126.9492 | 100 | 1.75 | 1.75 |
| -25.4629 | 80.80351 | 931.61 | 54.62 | 10 | 1200 | 30 | 900 | FALSE | 60 | 50 | 126.9492 | 100 | 1.75 | 1.75 |
| -25.4752 | 83.14572 | 934.98 | 54.62 | 10 | 1200 | 25 | 900 | FALSE | 60 | 50 | 126.9492 | 100 | 1.75 | 1.75 |

FIG. 8

METHOD, SYSTEM AND COMPUTER-READABLE MEDIUM FOR AUTOMATICALLY CONTROLLING A DRILLING OPERATION

TECHNICAL FIELD OF THE DISCLOSURE

The present disclosure relates to methods and systems for automatically controlling a drilling operation.

Background to the Disclosure

Directional drilling is type of drilling in which a wellbore is formed at an angle to the vertical. During directional drilling, the driller determines in which direction the borehole is to proceed. To do this, the drill string is held in one position (assuming no oscillator or rocker is being used) allowing the toolface, which has an inclined front face, to interact with the bottom of the borehole in a controlled manner. Since the drill string is not rotating, drilling is accomplished through a mud motor that harvests energy from drilling mud pumped through the drill string and through openings in the face of the drill bit. The harvested energy is used to spin the inclined front face.

After making a connection, the driller must re-position the toolface in the desired orientation, advance the tool until it touches the bottom of the borehole, and proceed with drilling. As the driller goes to set down, they will start circulation which starts spinning the mud motor. Often, the hole is slightly reamed to ensure that pre-existing torsional deformation is worked out and that the drill string is in an unsprung state.

Once the toolface contacts the bottom, there are many forces in play. Differential pressure, being the difference in pressure between the drill string and the annulus, is measured by measuring the increased pressure in the pipe when the toolface touches the bottom. Effectively, it is the back-pressure due to the mud motor and the toolface touching bottom. When the drill bit touches down, it creates a reactive torque on the drill string that immediately acts to rotate the drill string in a direction opposite to the mud motor. Differential pressure is used as a proxy for the reactive torque.

To counteract this reactive torque, the driller may put several "wraps" into the drill string—rotations from the surface. To maintain the correct steering angle, differential pressure and reactive torque are balanced. Steering changes can be made by varying the differential pressure and by making quill position adjustments. During a slide, differential pressure generally increases, indicative of increased reactive torque associated with increased depth. The increase in differential pressure is due to the driller accelerating the drilling and increasing the weight-on-bit as the slide deepens.

This process of controlling the mud motor and drill string is generally complicated and requires close attention from the drilling operator. There is therefore a need in the art for improved methods and systems for controlling drilling operations, especially directional drilling operations.

SUMMARY OF THE DISCLOSURE

In a first aspect of the disclosure, there is provided a method for automatically controlling a drilling operation. The method comprises obtaining a recording of one or more controlled drilling parameters adjusted, during a first drilling operation, in response to one or more controlling drilling parameters. Effectively, the recording comprises the one or more controlled drilling parameters as a function of the one or more controlling drilling parameters. The method further comprises, during a second drilling operation subsequent to the first drilling operation, monitoring the one or more controlling drilling parameters. The method further comprises, during the second drilling operation, automatically adjusting the one or more controlled drilling parameters in response to the monitored one or more controlling drilling parameters by using the recording of the one or more controlled drilling parameters and the one or more controlling drilling parameters.

Thus, one or more controlled drilling parameters may be automatically adjusted by using a past recording of controlled drilling parameters vs. controlling drilling parameters. This may be particular useful for drilling operations such as sliding, as the drilling operator must generally align the introduction of drill string torque with the simultaneous generation of reactive torque at the drill bit which is generated at a time which depends on various controlling parameters in play (e.g. bit depth, differential pressure), and which depends on these indices in a way which changes based on drilling conditions. In some cases, the controlling parameter values that are associated with substantial generation of reactive torque may not be aligned with mathematically significant data points such as 'hitting bottom' or 'differential pressure rise'. Instead, they may precede or lag such events due to unmeasurable or hard-to-model complex downhole interactions such as slowing of torque transmission along the pipe due to pipe friction, or due to the differential pressure signal travelling at the speed of sound. By implementing the playback feature described herein, controlled parameters may be adjusted more accurately, and with improved anticipation of, changes to controlling drilling parameters.

Obtaining the recording may comprise, during the first drilling operation, adjusting the one or more controlled drilling parameters in response to the one or more controlling drilling parameters, and recording the one or more controlled drilling parameters as a function of the one or more controlling drilling parameters.

The one or more controlled drilling parameters may comprise one or more of: a differential pressure, an on-bottom rate of penetration, an off-bottom rate of penetration, a toolface angle, a weight-on-bit, a torque, a rotary velocity of a drill bit, an amount of elapsed time, a top drive position, an oscillating status, a number of turns when oscillating, and a block height.

The one or more controlling drilling parameters may comprise one or more of: a differential pressure, an on-bottom rate of penetration, an off-bottom rate of penetration, a toolface angle, a weight-on-bit, a torque, a rotary velocity of a drill bit, an amount of elapsed time, a top drive position, an oscillating status, a number of turns when oscillating, and a block height.

Top drive position is equivalent to, or sometimes referred to, as quill position.

The one or more controlling drilling parameters may comprise a depth of a drill bit. The depth of the drill bit may comprise a distance from the drill bit to a hole bottom.

The one or more controlling drilling parameters may be variable in response to changes in the one or more controlled drilling parameters.

A selection of the one or more controlled drilling parameters being automatically adjusted may be variable in response to changes in the one or more controlling drilling parameter. For example, the recording may be of a first one of the one or more controlled drilling parameters adjusted in response to the one or more controlling drilling parameters, and, in response to a change in the one or more controlling drilling parameters, the recording may further be of a second one of the one or more controlled drilling parameters adjusted in response to the one or more controlling drilling parameters.

The method may further comprise obtaining a recording of an initial state of a drill bit prior to the first drilling operation, wherein the initial state corresponds to one or more initial controlled drilling parameters. The method may further comprise adjusting the one or more controlled drilling parameters using the recording of the initial state of the drill bit prior to automatically adjusting the one or more controlled drilling parameters. The initial state may comprise absolute values, or offsets, corresponding to the one or more initial controlled drilling parameters. Obtaining the recording of the initial state of the drill bit may comprise recording the initial state of the drill bit prior to the first drilling operation. The state of a drill bit may depend on quill position (e.g. top drive position) and/or toolface angle.

The method may further comprise, during the second drilling operation, ceasing further automatic adjustment of the one or more controlled drilling parameters in response to a user input.

The first and second drilling operations should be construed broadly, and may encompass any operation associated with drilling. The first and second drilling operations may comprise one or more of: on-bottom drilling, reaming, washing, circulating, tripping, touching bottom, orientating a toolface, and directional drilling.

The method may further comprise, during the automatic adjustment of the one or more controlled drilling parameters, further adjusting the one or more controlled drilling parameters in response to a user input. The method may further comprise recording, during the automatic adjustment, the one or more controlled drilling parameters as a function of the one or more controlling drilling parameters, thereby generating a user-adjusted recording. The method may further comprise, during a third drilling operation subsequent to the second drilling operation, monitoring the one or more controlling drilling parameters, automatically adjusting the one or more controlled drilling parameters in response to the monitored one or more controlling drilling parameters by using the user-adjusted recording.

Automatically adjusting the one or more controlled drilling parameters may comprise automatically adjusting the one or more controlled drilling parameters in response to a first controlling drilling parameter of the monitored one or more controlling drilling parameters. The method may further comprise switching from automatically adjusting the one or more controlled drilling parameters in response to the first controlling drilling parameter to automatically adjusting the one or more controlled drilling parameters in response to a second controlling drilling parameter of the monitored one or more controlling drilling parameters.

The method may further comprise selecting one or more portions of the recording, wherein the one or more portions comprise one or more ranges of the one or more controlling drilling parameters. Automatically adjusting the one or more controlled drilling parameters may comprise automatically adjusting the one or more controlled drilling parameters in response to the monitored one or more controlling drilling parameters by using the one or more selected portions of the recording.

In a further aspect of the disclosure, there is provided a system for automatically controlling a drilling operation. The system comprises one or more controlling drilling parameter sensors for reading one or more controlling drilling parameters. The system further comprises an automatic driller communicative coupled to each of the one or more controlling drilling parameter sensors. The automatic driller is configured to obtain a recording of one or more controlled drilling parameters adjusted, during a first drilling operation, in response to the one or more controlling drilling parameters. The automatic driller is further configured to, during a second drilling operation subsequent to the first drilling operation, monitor the one or more controlling drilling parameters. The automatic driller is further configured to, during the second drilling operation, automatically adjust the one or more controlled drilling parameters in response to the monitored one or more controlling drilling parameters by using the recording of the one or more controlled drilling parameters.

The system may further comprise one or more controlled drilling parameter sensors for reading the one or more controlled drilling parameters. The automatic driller may be communicatively coupled to each of the one or more controlled drilling parameter sensors. The automatic driller may be further configured to determine, during the first drilling operation, the one or more controlled drilling parameters from readings taken by the one or more controlled drilling parameter sensors. The automatic driller may be further configured to determine, during the first drilling operation, the one or more controlling drilling parameters from readings taken by the one or more controlling drilling parameter sensors, so as to obtain the recording of the one or more controlling drilling parameters adjusted, during the first drilling operation, in response to the one or more controlling drilling parameters.

The automatic driller may be further configured to variably select the one or more controlled drilling parameters for automatic adjustment in response to changes in the one or more controlling drilling parameter.

The automatic driller may be further configured to obtain a recording of an initial state of a drill bit prior to the first drilling operation, wherein the initial state corresponds to one or more initial controlled drilling parameters. The automatic driller may be further configured to adjust the one or more controlled drilling parameters using the recording of the initial state of the drill bit prior to automatically adjusting the one or more controlled drilling parameters.

The automatic driller may be further configured to record the initial state of the drill bit prior to the first drilling operation.

The automatic driller may be further configured to receive a user input, and further adjust the one or more controlled drilling parameters in response to the user input. The automatic driller may be further configured to generate a user-adjusted recording by recording, during the automatic adjustment, the one or more controlled drilling parameters as a function of the one or more controlling drilling parameters. The automatic driller may be further configured to monitor the one or more controlling drilling parameters, and automatically adjust the one or more controlled drilling parameters in response to the monitored one or more controlling drilling parameters by using the user-adjusted recording.

The automatic driller may be further configured to receive a user input, cease further automatic adjustment of the one or more controlled drilling parameters in response to the user input.

The automatic driller may be further configured to automatically adjust the one or more controlled drilling parameters in response to a first controlling drilling parameter of the monitored one or more controlling drilling parameters, and switch from automatically adjusting the one or more controlled drilling parameters in response to the first controlling drilling parameter to automatically adjusting the one or more controlled drilling parameters in response to a second controlling drilling parameter of the monitored one or more controlling drilling parameters.

The automatic driller may be further configured to receive a selection of one or more portions of the recording, wherein the one or more portions comprise one or more ranges of the one or more controlling drilling parameters. The automatic driller may be further configured to automatically adjust the one or more controlled drilling parameters in response to the monitored one or more controlling drilling parameters by using the one or more selected portions of the recording.

In a further aspect of the disclosure, there is provided a non-transitory computer-readable medium having computer program code stored thereon, the computer program code configured, when executed by a computer, to cause the computer to carry out a method. The method comprises accessing a recording of one or more controlled drilling parameters adjusted, during a first drilling operation, in response to one or more controlling drilling parameters. The method further comprises, during a second drilling operation subsequent to the first drilling operation: monitoring the one or more controlling drilling parameters, and automatically adjusting the one or more controlled drilling parameters in response to the monitored one or more controlling drilling parameters by using the recording of the one or more controlled drilling parameters.

Accessing the recording may comprise, during the first drilling operation, adjusting the one or more controlled drilling parameters in response to the one or more controlling drilling parameters, and recording the one or more controlled drilling parameters as a function of the one or more controlling drilling parameters.

The method may further comprise accessing a recording of an initial state of a drill bit prior to the first drilling operation, wherein the initial state corresponds to one or more initial controlled drilling parameters, and adjusting the one or more controlled drilling parameters using the recording of the initial state of the drill bit prior to automatically adjusting the one or more controlled drilling parameters.

Accessing the recording of the initial state of the drill bit may comprise recording the initial state of the drill bit prior to the first drilling operation.

The method may further comprise, during the second drilling operation, ceasing further automatic adjustment of the one or more controlled drilling parameters in response to a user input.

The method may further comprise variably selecting the one or more controlled drilling parameters for automatic adjustment in response to changes in the one or more controlling drilling parameter.

The method may further comprise, during the automatic adjustment of the one or more controlled drilling parameters, further adjusting the one or more controlled drilling parameters in response to a user input. The method may further comprise recording, during the automatic adjustment, the one or more controlled drilling parameters as a function of the one or more controlling drilling parameters, thereby generating a user-adjusted recording. The method may further comprise, during a third drilling operation subsequent to the second drilling operation, monitoring the one or more controlling drilling parameters, and automatically adjusting the one or more controlled drilling parameters in response to the monitored one or more controlling drilling parameters by using the user-adjusted recording.

Automatically adjusting the one or more controlled drilling parameters may comprise automatically adjusting the one or more controlled drilling parameters in response to a first controlling drilling parameter of the monitored one or more controlling drilling parameters, and the method may further comprise switching from automatically adjusting the one or more controlled drilling parameters in response to the first controlling drilling parameter to automatically adjusting the one or more controlled drilling parameters in response to a second controlling drilling parameter of the monitored one or more controlling drilling parameters.

The method may further comprise receiving a selection of one or more portions of the recording, wherein the one or more portions comprise one or more ranges of the one or more controlling drilling parameters. The method may further comprise automatically adjusting the one or more controlled drilling parameters in response to the monitored one or more controlling drilling parameters by using the one or more selected portions of the recording.

BRIEF DESCRIPTION OF THE DRAWINGS

In the accompanying drawings, which illustrate one or more example embodiments:

FIG. 5 depicts an example recording of controlling drilling parameters and controlled drilling parameters, obtained during a recording phase;

FIG. 8 depicts an example recording of controlling drilling parameters and controlled drilling parameters, obtained during a recording phase;

DETAILED DESCRIPTION

Figure 1:
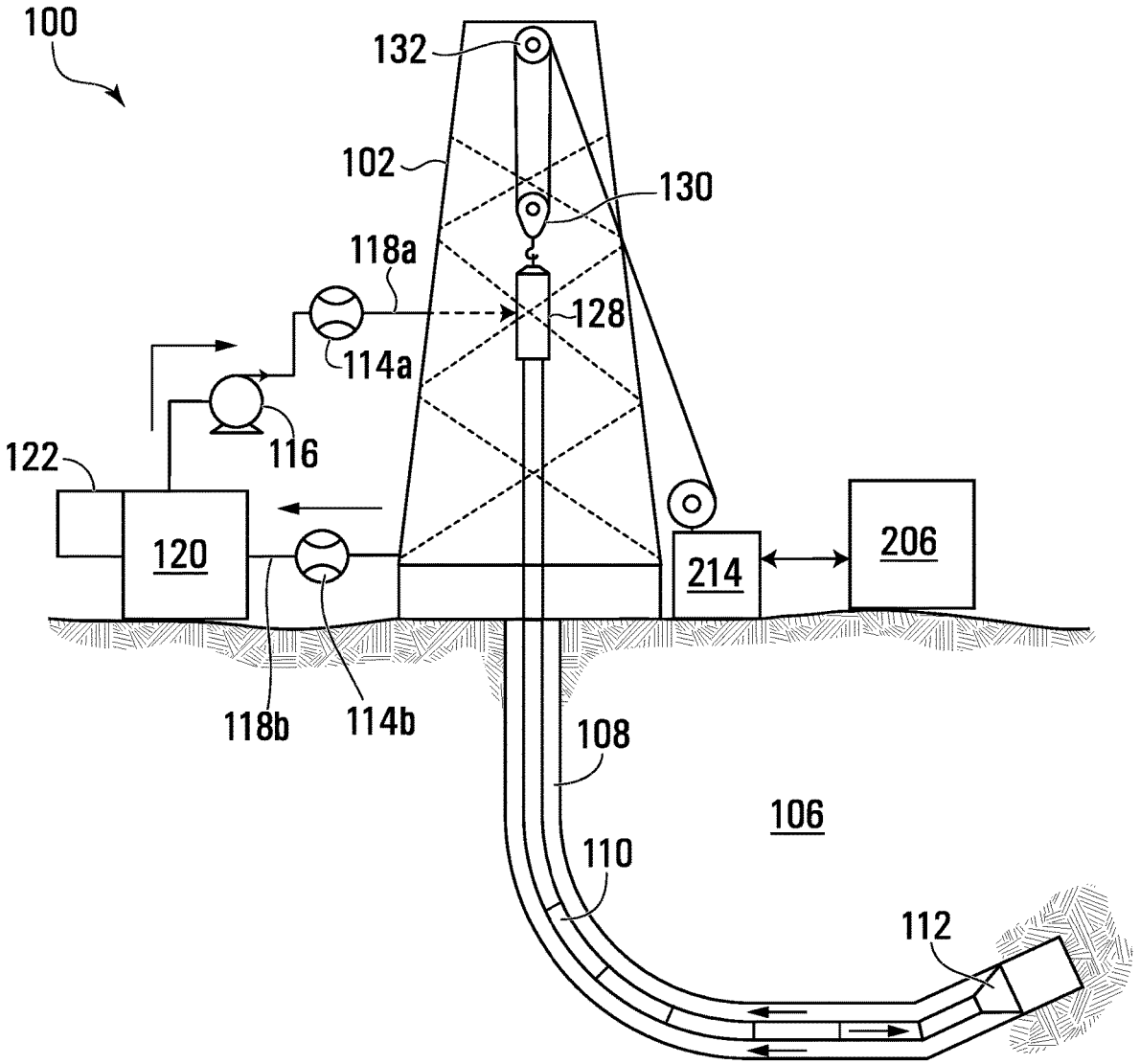
FIG. 1 depicts an oil rig that is being used to drill a directional well, in conjunction with an automatic driller, according to one example embodiment of the disclosure.

The present disclosure seeks to provide improved methods and systems for automatically controlling a drilling operation. While various embodiments of the disclosure are described below, the disclosure is not limited to these embodiments, and variations of these embodiments may well fall within the scope of the disclosure which is to be limited only by the appended claims.

Directional terms such as "top", "bottom", "upwards", "downwards", "vertically" and "laterally" are used in this disclosure for the purpose of providing relative reference only, and are not intended to suggest any limitations on how any article is to be positioned during use, or to be mounted in an assembly or relative to an environment.

Additionally, the term "couple" and variants of it such as "coupled", "couples", and "coupling" as used in this disclosure are intended to include indirect and direct connections unless otherwise indicated. For example, if a first article is coupled to a second article, that coupling may be through a direct connection or through an indirect connection via one or more other articles.

Furthermore, the singular forms "a", "an", and "the" as used in this disclosure are intended to include the plural forms as well, unless the context clearly indicates otherwise.

During well drilling, multiple sensors may be used to monitor various drilling parameters such as weight-on-bit (WoB), block height, torque applied to the drill string, rate of penetration (ROP), and differential pressure. These drilling parameters may be controlled by the drilling operator, by setting one or more corresponding drilling parameter setpoints. When being controlled by the drilling operator, such parameters may be referred to as controlled drilling parameters. For example, top position may be increased or decreased by adjusting a corresponding top drive position setpoint set by the operator, and under such conditions is a controlled drilling parameter. Drilling parameters may also change in response to changes in other drilling parameters, in which case the drilling parameters may be referred to as controlling drilling parameters. For example, block height (which is a measure of the distance separating the drilling rig's travelling block from the drilling floor, and which may be used as a proxy for bit depth) may be a controlling drilling parameter and may change in response to the depth to which the well has been drilled. These sensors that measure both the controlled drilling parameters and the controlling drilling parameters are communicative with an automatic driller.

Controlled and controlling drilling parameters overlap. In particular, any controlled drilling parameter may also act as a controlling drilling parameter, and vice versa. For example, differential pressure may be a controlling drilling parameter based on the fact that it changes in response to WoB, pump rate, and downhole conditions. However, differential pressure may also be a controlled drilling parameter as its corresponding setpoint may be adjusted by the automatic driller in an attempt to control it.

During a first drilling operation, the drilling operator may adjust one or more of the controlled drilling parameters (hereinafter "controlled drilling parameters") in response to one or more of the monitored controlling drilling parameters (hereinafter "controlling drilling parameters"). For example, the operator may adjust the controlled drilling parameter setpoints in response to changes in the controlling drilling parameters. Adjustments to the controlled drilling parameters, in response to changes in the controlling drilling parameters, may be recorded by the automatic driller during a recording phase.

During a second drilling operation subsequent to the first drilling operation, the automatic driller may enter a playback phase in which the controlling drilling parameters are monitored. In order that the drilling operator does not have to repeat the adjustments to the controlled drilling parameters, the automatic driller may automatically adjust the controlled drilling parameters in response to the monitored controlling drilling parameters, by using the recording of the controlled drilling parameters that was obtained during the recording phase. Thus, by recording the driller's instructions once (during the recording phase) and automatically replaying them during successive playback phases, the drilling is made more efficient and simpler. Operator fatigue is also less likely to be a problem. Furthermore, adjustments to the controlled drilling parameters are more accurate in both time and amplitude.

The recording and playback phases may be used at various stages of drilling. For example, in one embodiment the recording and playback phases are used during directional drilling. During directional drilling, when a new length of pipe is added to the drill string, the objective is to arrive at a specific toolface. As the drill bit bites into the rock, reactive torque is introduced and causes the bit to turn. To counteract this reactive torque, the driller introduces one or more wraps (rotations to the drill string), as discussed above. This procedure is complicated and timing is critical to achieving the correct toolface to guide the toolface to its target. The timing can be based for example on differential pressure, relative depth, or time. Adding the precise amount of wraps at the correct time/pressure/depth is particularly critical when directional drilling, and thus the recording and playback phases discussed herein are particular useful for directional drilling, since responsibility for adjusting the drilling parameter setpoints is handed over to the automatic driller.

Referring now to FIG. 1, there is shown an oil rig that is being used to directionally drill a well in conjunction with an automatic driller 206, which comprises part of an example system for automatically controlling a drilling operation. The rig comprises a derrick 102 from which downwardly extends into a formation 106 a drill string 110 at the end of which is a drill bit 112. The drill bit 112 is connected to the drill string 110 via a bent sub (unlabelled). Mounted to the derrick 102 are a crown block 132 and a travelling block 130 that is movable by means of a pulley system relative to the crown block 132. A top drive 128 is attached to the bottom of the travelling block 130 via a hook and connects the travelling block 130 to the drill string 110. The top drive 128 provides the torque and consequent rotary force used to rotate the drill string 110 through the formation 106. A drawworks 214 is at the base of the rig and comprises a pulley system that connects the drawworks 214 to the crown block 132 and that enables the drawworks 214 to vertically translate the travelling block 128 relative to the crown block 132. By actuating its pulley, the drawworks 214 is accordingly able to apply vertical forces to the drill string 110 and adjust its rate of penetration. While the drill string 110 in the depicted embodiment is rotatably powered by the top drive 128, in different embodiments (not depicted) the top drive 128 may be replaced with a swivel, rotary table and kelly. Rotation of the drill bit 112 through the formation 106 drills a directional well 108.

A reservoir 120 for drilling fluid (hereinafter interchangeably referred to as a "mud tank 120" or "mud pit 120") stores drilling fluid for pumping into the well 108 via the drill string 110. A volume meter 122 is affixed to the mud tank 120 and is used to measure the total volume of the drilling fluid stored in the mud tank 120 at any particular time (this volume is hereinafter interchangeably referred to as "pit volume"). A closed fluid circuit comprises the mud tank 120, a fluid input line 118*a* for sending the drilling fluid down the interior of the drill string 110 via the top drive 128 and subsequently into the annulus between the drill string 110 and the annular surface of the well 108, and a fluid return line 118*b* for returning the drilling fluid from that annulus to the mud tank 120; the direction of drilling fluid flow along this closed fluid circuit is shown by arrows in FIG. 1. A mud pump 116 is fluidly coupled to and located along the fluid input line 118*a* and is used to pump the drilling fluid from the mud tank 120 into the drill string 110. An input flow meter 114*a* and a return flow meter 114*b* are fluidly coupled to and located along the fluid input line 118*a* and fluid return line 118*b*, respectively, and are used to monitor flow rates into and out of the well 108. A driller's cabin and doghouse are not shown in FIG. 1, but in certain embodiments are also present at the rigsite and are discussed in respect of FIG. 2, below.

The rig also comprises various sensors (depicted in FIG. 2), such as a hookload sensor 222, standpipe pressure sensor 220, torque sensor 218, block height sensor 216, top drive position sensor 228, top drive rotary sensor 232, and MWD (Measurement While Drilling) sensors 230, discussed in more detail below. As discussed in further detail below, sensor readings are sent to the automatic driller 206 and are used to enable automatic control of a drilling operation by the automatic driller 206.

Figure 2:
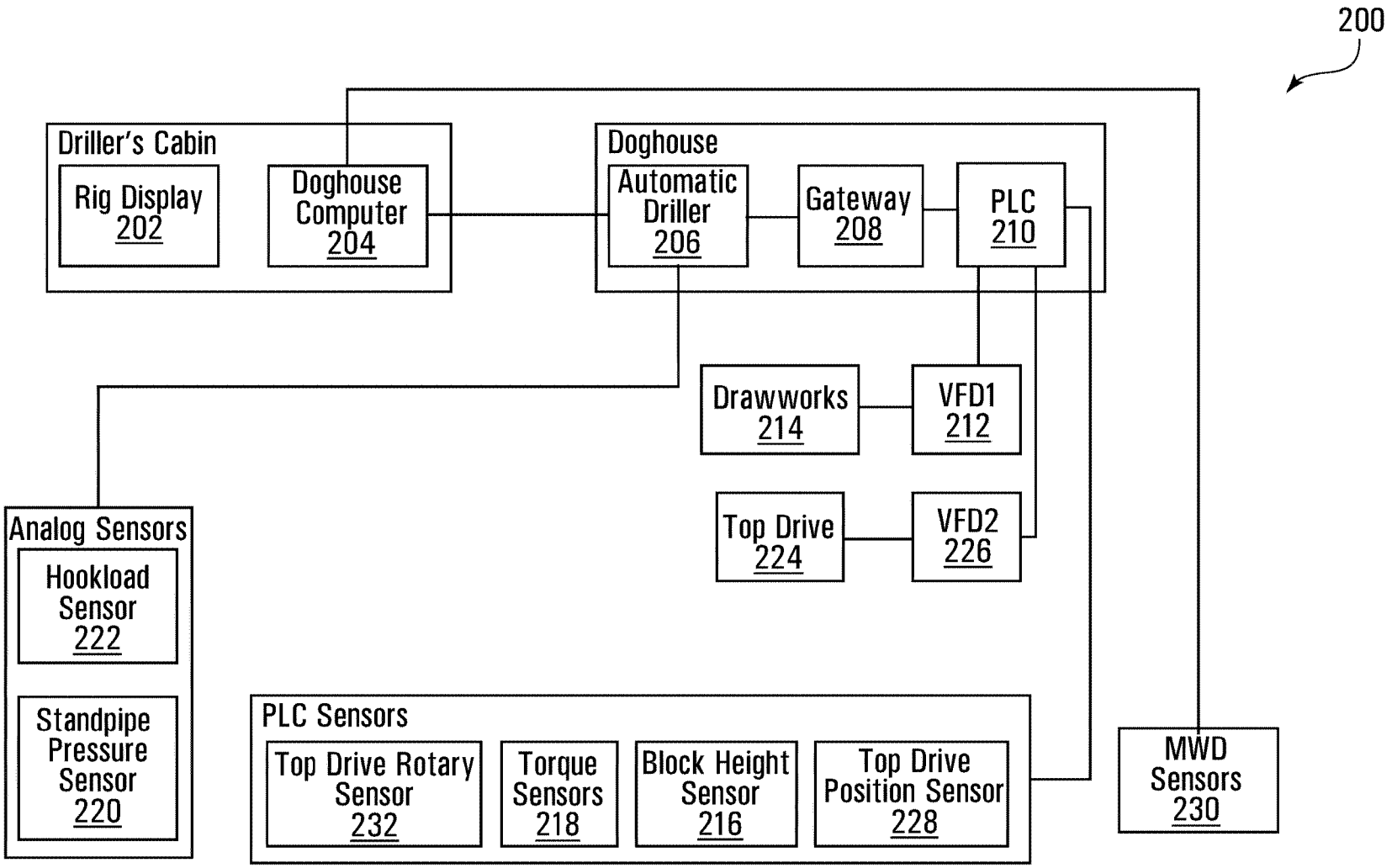
FIG. 2 depicts a block diagram of an embodiment of a system for automatically controlling a drilling operation and that comprises the automatic driller of FIG. 1.
Figure 3:
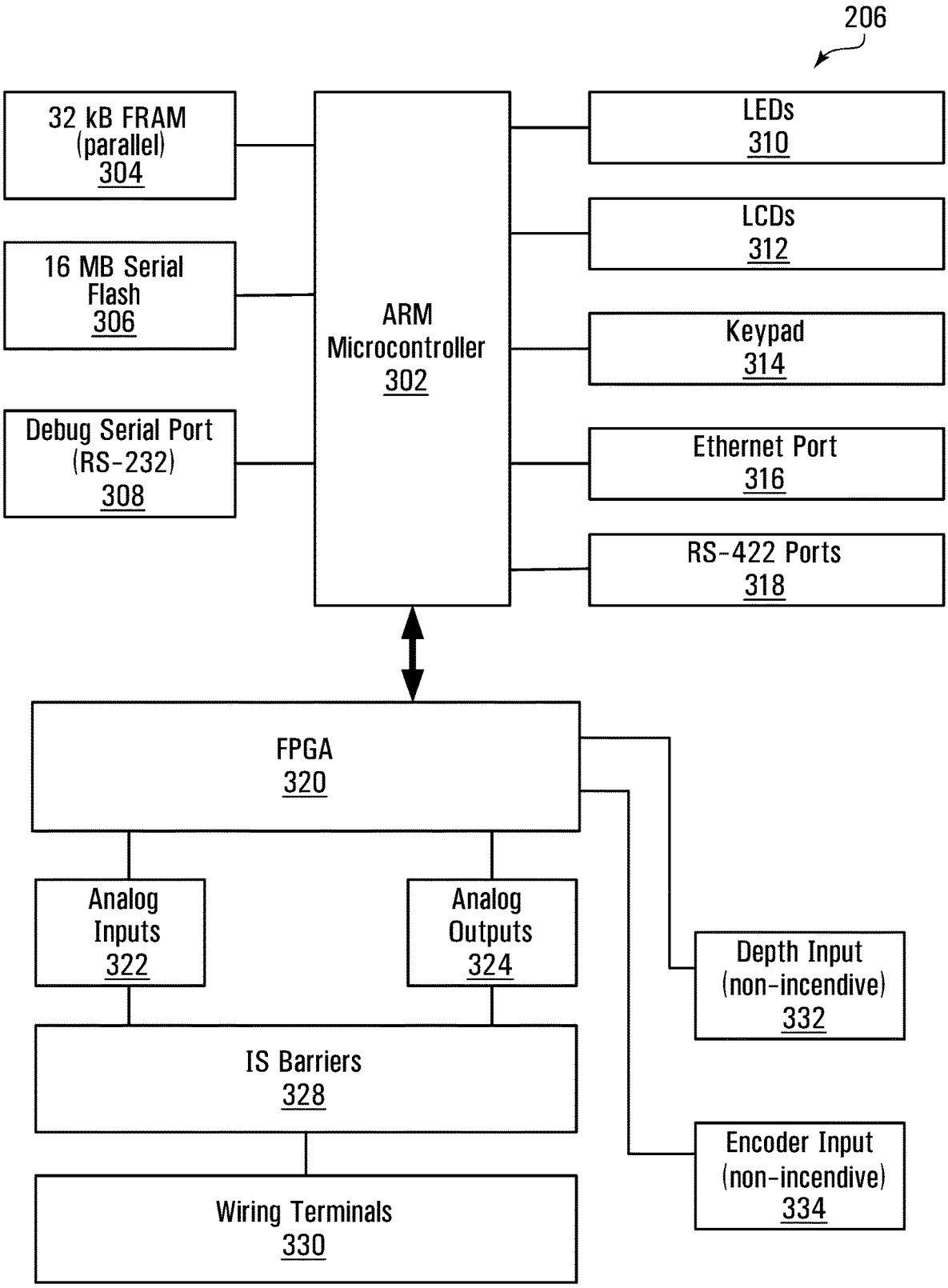
FIG. 3 depicts a block diagram of the automatic driller of FIG. 1.

Referring now to FIG. 2, there is shown a hardware block diagram 200 of the embodiment of the system 100 of FIG. 1. An automatic driller 206, which is shown in more detail in FIG. 3, is present in the doghouse and is configured to perform a method for automatic control of a drilling operation, as described in more detail below. An example automatic driller that may be modified to perform the method is the Automatic Driller™ offered by Pason Systems Corp.™ The automatic driller 206 is communicatively coupled to a doghouse computer 204 and a rig display 202 in a driller's cabin; the doghouse computer 204 and rig display 202 each permit a driller to interface with the automatic driller 206 by, for example, setting drilling parameter setpoints and obtaining drilling parameter measurements. The rig display 202 may be, for example, the Rig Display™ offered by Pason Systems Corp.™

The automatic driller 206 is located within a doghouse and transmits and receives analog signals and indirectly transmits and receives digital signals. The automatic driller 206 is directly communicatively coupled to a hookload sensor 222 and a standpipe pressure sensor 220, which the automatic driller 206 uses to obtain WoB and differential pressure measurements, respectively. Each of the hookload and pressure sensors 222, 220 sends an analog signal directly to the automatic driller 206. The automatic driller 206 is indirectly communicatively coupled to a torque sensor 218, a block height sensor 216, a top drive position sensor 228, and a top drive rotary sensor 232 that digitally transmit measurements indicating the amount of torque applied to a drill string 110 by, for example, the top drive 128, the height of the travelling block 130, the position of the top drive 224, and the speed of rotation of the top drive 224. These digital measurements are sent to a programmable logic controller ("PLC") 210 in the doghouse. The automatic driller 206 is also indirectly communicatively coupled to MWD sensors 230 that send signals directly to the doghouse computer 204 in the driller's cabin, for processing on the doghouse computer 204.

The automatic driller 206 is also coupled via the PLC 210 to a first variable frequency drive ("VFD1") 212, which is used to control the drum speed of the drawworks 214. The drawworks 214 is used to adjust the height of the travelling block 130 of the rig. The automatic driller 206 is further coupled via the PLC 210 to a second variable frequency drive ("VFD2") 226, which is used to control the speed of the top drive 224. An example variable frequency drive is a Yaskawa™ A1000 VFD, and an example PLC is a Siemens™ SIMATIC™ S7 series PLC. The PLC 210 transmits those signals to the automatic driller 206 via a gateway 208.

In other embodiments (not depicted), the automatic driller 206 may communicate with equipment via only a digital interface, only an analog interface, or communicate with a different combination of analog and digital interfaces than that shown in FIG. 2. For example, in one different embodiment (not depicted) the automatic driller 206 communicates using an analog interface with all of the sensors 216, 218, 220, 222, 228, 230, 232. In another different embodiment (not depicted), the automatic driller 206 communicates using a digital interface (e.g., via the PLC 210) to all of the sensors 216, 218, 220, 222, 228, 230, 232. In another different embodiment (not depicted), the automatic driller 206 may directly control the drawworks 214 or VFD1 212, and/or the top drive 224 or VFD2 226, without using the PLC 210 as an intermediary.

FIGS. 1 and 2 depict one embodiment of an oil rig and oil rig system that may be used with the methods and systems described herein. In other embodiments, other types of rigs may be used, such as bandbrake and hydraulic hoist rigs.

Referring now to FIG. 3, there is shown a hardware block diagram 300 of the automatic driller 206 of FIG. 2, according to one embodiment. Note that in other embodiments the automatic driller 206 may comprise more or fewer of the components illustrated in FIG. 3. In the present embodiment of FIG. 3, the automatic driller 206 comprises a microcontroller 302 communicatively coupled to a field programmable gate array ("FPGA") 320. The depicted microcontroller 302 is an ARM-based microcontroller, although in different embodiments (not depicted) the microcontroller 302 may use a different architecture. The microcontroller 302 is communicatively coupled to 32 kB of non-volatile random access memory ("RAM") in the form of ferroelectric RAM 304; 16 MB of flash memory 306; a serial port 308 used for debugging purposes; LEDs 310, LCDs 312, and a keypad 314 to permit a driller to interface with the automatic driller 206; and communication ports in the form of an Ethernet port 316 and RS-422 ports 318. While FIG. 3 shows the microcontroller 302 in combination with the FPGA 320, in different embodiments (not depicted) different hardware may be used. For example, the microcontroller 302 may be used to perform the functionality of both the FPGA 320 and microcontroller 302 in FIG. 3; alternatively, a PLC may be used in place of one or both of the microcontroller 302 and the FPGA 320.

The microcontroller 302 communicates with the hookload and standpipe pressure sensors 222, 220 via the FPGA 320. More specifically, the FPGA 320 receives signals from these sensors 222, 220 as analog inputs 322; the FPGA 320 is also able to send analog signals using analog outputs 324. These inputs 322 and outputs 324 are routed through intrinsic safety ("IS") barriers for safety purposes, and through wiring terminals 330. The microcontroller 302 communicates using the RS-422 ports 318 to the gateway 208 and the PLC 210; accordingly, the microcontroller 302 receives signals from the block height, torque, top drive position, top drive rotary, and MWD sensors 216, 218, 228, 230, 232 and sends signals to the VFD1 and VFD2 212, 226 via the RS-422 ports 318.

The FPGA 320 is also communicatively coupled to a non-incendive depth input 332 and a non-incendive encoder input 334. In different embodiments (not depicted), the automatic driller 206 may receive different sensor readings in addition to or as an alternative to the readings obtained using the depicted sensors 216, 218, 220, 222, 228, 230, 232.

Figure 4:
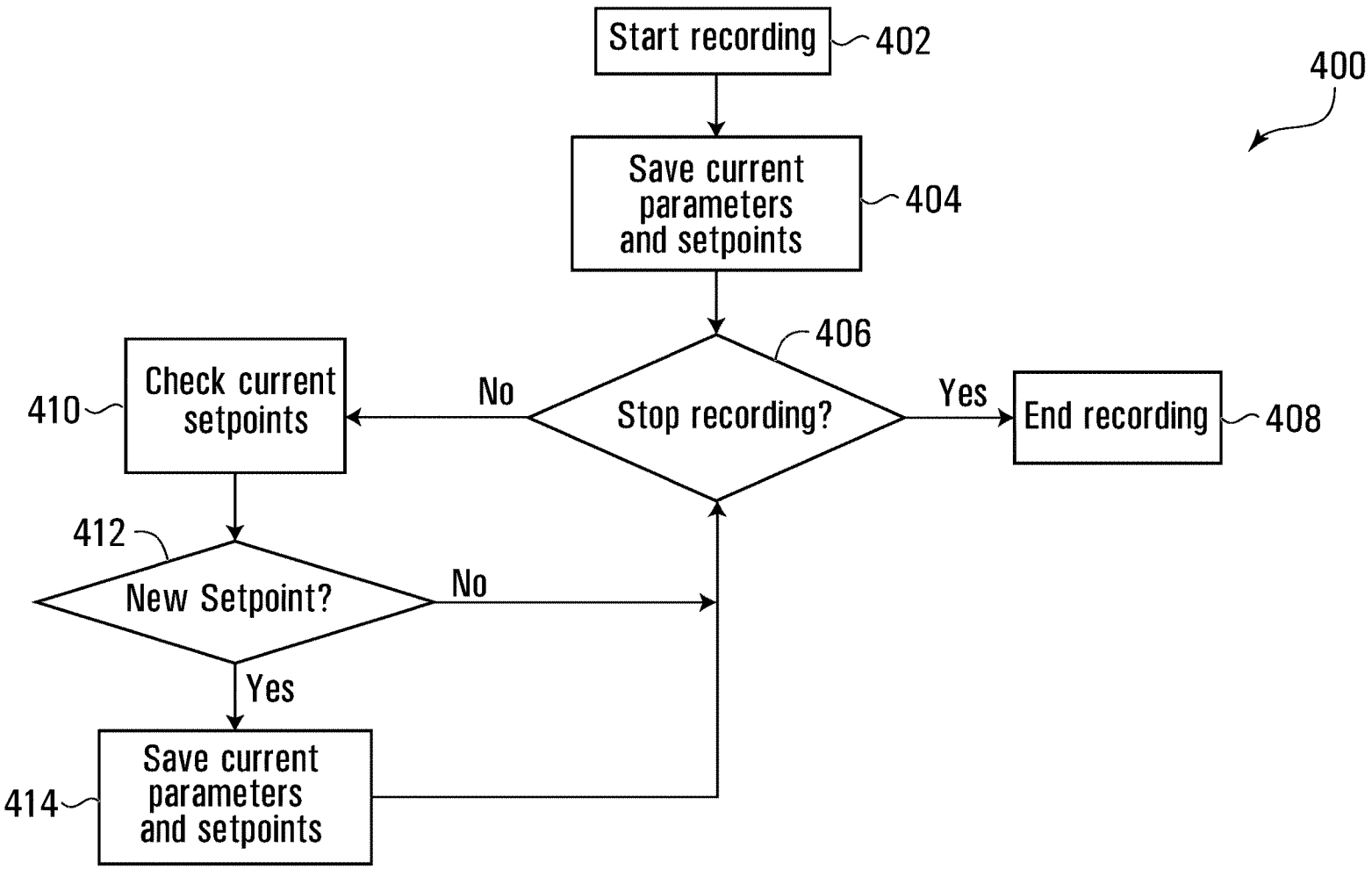
FIG. 4 depicts a recording phase of a method for automatically controlling a drilling operation, according to an example embodiment of the disclosure.

Turning to FIG. 4, there is shown a recording phase of a method of automatically controlling a drilling operation, in accordance with an embodiment of the disclosure. The recording phase may be implemented during a first drilling operation, for example during a first period of directional drilling. The process 400 begins at block 402 at which, in response to a user input, the automatic driller 206 begins recording the controlled and controlling drilling parameters, as discussed above. For example, the automatic driller 206 monitors and saves the readings from the hookload, standpipe pressure, torque, block height, top drive position, top drive rotary, and MWD sensors 216, 218, 220, 222, 228, 230, 232. At block 404, the automatic driller 206 saves the controlled drilling parameter setpoints that are input to the automatic driller 206 by the drilling operator. For example, during the first drilling operation, the operator adjusts one or more of the controlled drilling parameter setpoints in response to, or in anticipation of, changes in drilling conditions, and more particularly in response to changes in the controlling drilling parameters. For instance, upon noticing, or in anticipation of, an increase in reactive torque as indicated by the differential pressure reading calculated from the standpipe pressure sensor 220, the operator may input to the automatic driller 206 a different (e.g. higher) top drive position setpoint to counteract the increase in reactive torque. The new top drive position setpoint is recorded by the automatic driller 206.

Process 400 then moves to block 406 at which the automatic driller 206 determines whether to end the recording. For example, the operator may provide user input signalling to the automatic driller 206 that it is to cease recording. If the automatic driller 206 determines that it is to cease recording, then the process 400 moves to block 408 at which the recording is stopped and the recording phase terminates. If the automatic driller 206 determines that it is to continue recording, then at block 410 the automatic driller 206 identifies the current controlled drilling parameter setpoints. At block 412, the automatic driller 206 determines whether any of the controlled drilling parameter setpoints are new controlled drilling parameter setpoints that have been input by the operator. If not, then the process 400 returns to block 406 at which the automatic driller 206 determines whether to continue or stop recording, as described above. If new drilling controlled parameter setpoints have been input by the operator, then the automatic driller 206 saves the new controlled drilling parameter setpoints, and then the process 400 returns to block 406. Eventually, the operator will command the automatic driller 206 to cease recording, signalling the end of the recording phase.

other embodiments, the recording may be left running passively in the background and the drilling operator may select one or more portions of the recording for playback during a playback phase, as discussed in more detail below. In such cases, the recording phase may continue to run in parallel to the playback phase.

An example recording of drilling parameters obtained during a recording phase is shown in FIG. 5, corresponding to a slide. In FIG. 5, the following parameters are controlling drilling parameters: block position, time, differential pressure, and toolface angle. Furthermore, the following parameters are controlled drilling parameters whose setpoints are adjusted during the first drilling operation: WOB SP (Weight-on-Bit), DIFP SP (Differential Pressure), ROP SP (Rate of Penetration), Torque SP, Oscillator SP, RPM SP, Slide RPM SP, Top position SP, Off bottom ROP SP, Left turns SP (the number of turns, or wraps, to the left when oscillating), and Right turns SP (the number of turns, or wraps, to the right when oscillating).

It should be noted that, in other embodiments, one or more of the controlling drilling parameters shown in FIG. 5 may be controlled drilling parameters instead or as well, and one or more of the controlled drilling parameters may be controlling drilling parameters instead or as well. Usually, off-bottom bit depth is a controlling parameter. Block height is also usually a controlling drilling parameter.

Figure 6:
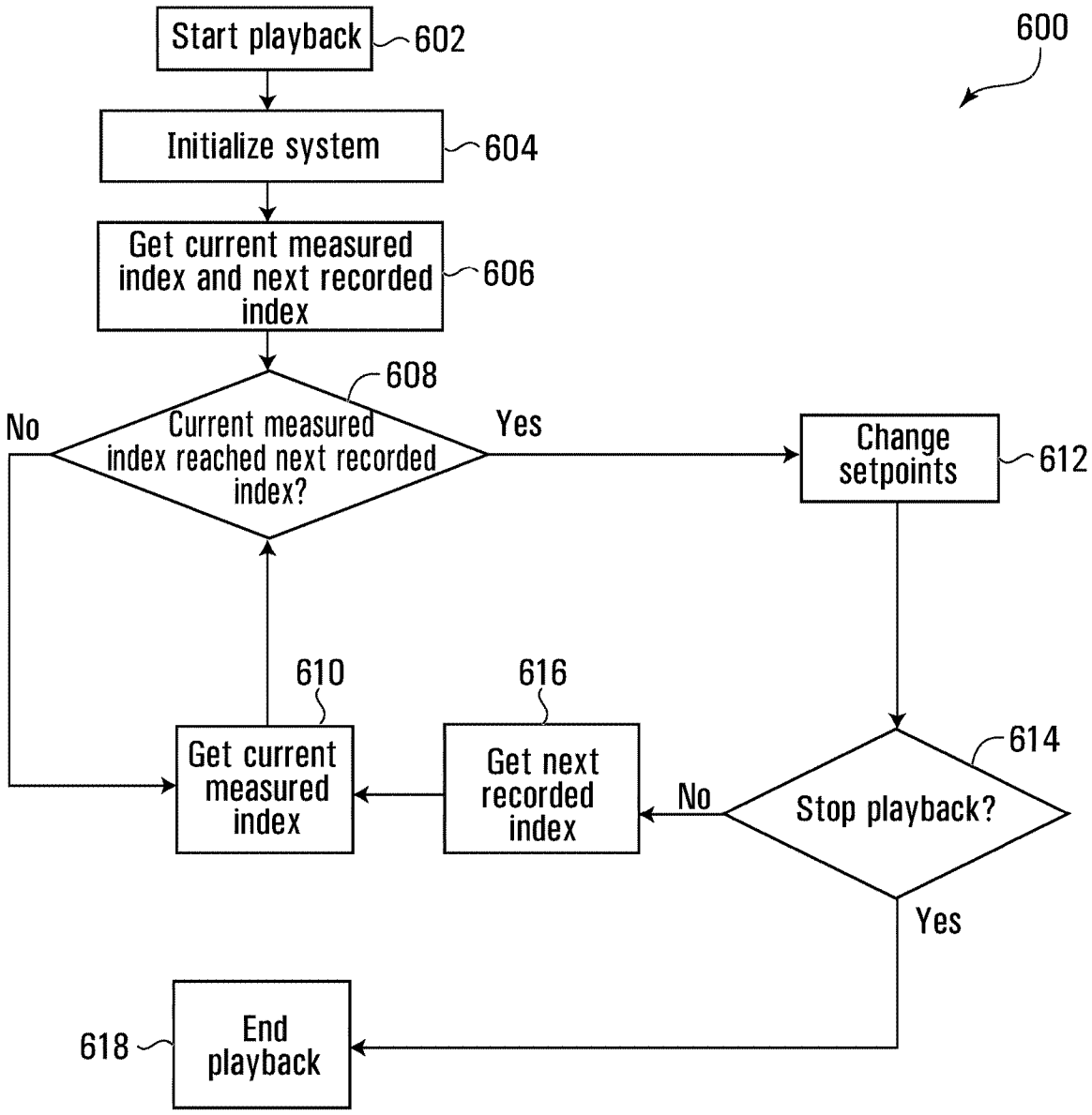
FIG. 6 depicts a playback phase of a method for automatically controlling a drilling operation, according to an example embodiment of the disclosure.

Now turning to FIG. 6, there is shown a playback phase of a method of automatically controlling a drilling operation, in accordance with an embodiment of the disclosure. The playback phase may be initiated after a recording phase has taken place (or during a recording phase running in parallel to the playback phase), for example during a second drilling operation that occurs subsequent to the first drilling operation. For instance, the second drilling operation may comprise a period of directional drilling that follows the directional drilling of the first drilling operation, once a new segment of pipe has been added to the drill string. The playback phase effectively allows the operator to let the automatic driller 206 guide the drilling process, using the recorded data from the recording phase.

The playback process 600 starts at block 602, in response to a user input. The process 600 then moves to block 604 at which the system is initialized. At system initialization, generally the toolface is oriented to the same angle (or in a different embodiment an offset) as it was at the start of the recording. System initialization is discussed in further detail below. The process moves to block 606 at which the automatic driller 206 determines the current measured index and the next recorded index. In the context of FIG. 6, the index is the controlling drilling parameter against which the controlled drilling parameters will be adjusted. In one embodiment, the index is bit depth. In another embodiment, the index is block height. The next recorded index is the corresponding recorded controlling drilling parameter whose value indicates a more advanced progression through the drilling process. For some drilling parameters, such as block height, the next recorded index is generally lower than the current measured index (as block height decreases during the drilling process). For other drilling parameters, such as differential pressure, the next recorded index is generally higher than the current measured index (as differential pressure increases during the drilling process). For instance, if during the recording phase the bit depth was recorded every 0.01 meters, and if the current bit depth is read as 10 meters, then the next recorded bit depth is determined to be 10.01 meters.

The process 600 then moves to block 608 at which the automatic driller 206 determines whether the current measured index has reached the next recorded index. If the current measured index has not reached the next recorded index, then the process 600 moves to block 610 at which the automatic driller 206 obtains the latest current index, and the process 600 then returns to block 608. Blocks 608 and 610 are then looped until the current index is determined by the automatic driller 206 to have reached the next recorded index, at which point the process 600 moves to block 612. Once the current index is determined to have reached the next recorded index, then at block 612 the current controlled drilling parameter setpoints are adjusted based on the controlled drilling parameters recorded during the recording phase and which correspond to the next recorded index. For example, using the example above, once the current bit depth is determined to have reached 10.01 meters, then the controlled drilling parameter setpoints recorded during the recording phase for a bit depth of 10.01 meters are used to update the current controlled drilling parameter setpoints. Thus, the automatic driller 206 adjusts the controlled drilling parameter setpoints in response to changes in the index (e.g. controlling drilling parameter), by using the recording obtained during the recording phase.

The process 600 then moves to block 614 at which the automatic driller 206 determines whether playback should be stopped, i.e. if there are no more recorded indices in the recording. If there are no more recorded indices in the recording, then the process 600 moves to block 618 at which the process 600 ends and the playback phase is terminated. Effectively, at this point there are no longer any recorded indices that would enable the automatic driller 206 to automatically adjust the controlled drilling parameter setpoints in order to control the drilling operation. If the automatic driller 206 determines that there are more recorded indices in the recording, then the process moves to block 616 at which the next recorded index is obtained, the current measured index is obtained (block 610), and a determination is made as to whether the current measured index has reached the next recorded index (block 608), as described above.

While in the above example bit depth is used as the index, in other embodiments any other suitable controlling drilling parameter(s) may be used, such as block height, differential pressure, and/or elapsed time.

Thus, FIGS. 4 and 6 show two phases of a method for automatically controlling a drilling operation. In a first, recording phase, controlling drilling parameters are monitored, and controlled drilling parameter setpoints are adjusted in response to changes in the controlling drilling parameters. Changes to the controlled drilling parameter setpoints are recorded as a function of changes to the monitored controlling drilling parameters. In a second, playback phase, control of the drilling operation may effectively be handed over to the automatic driller 206. In particular, the automatic driller 206 uses the recording obtained during the recording phase to automatically adjust the controlled drilling parameter setpoints in response to changes in the controlling drilling parameters, by comparing the (current) controlling drilling parameters to the corresponding recorded controlling drilling parameters.

Figure 7:
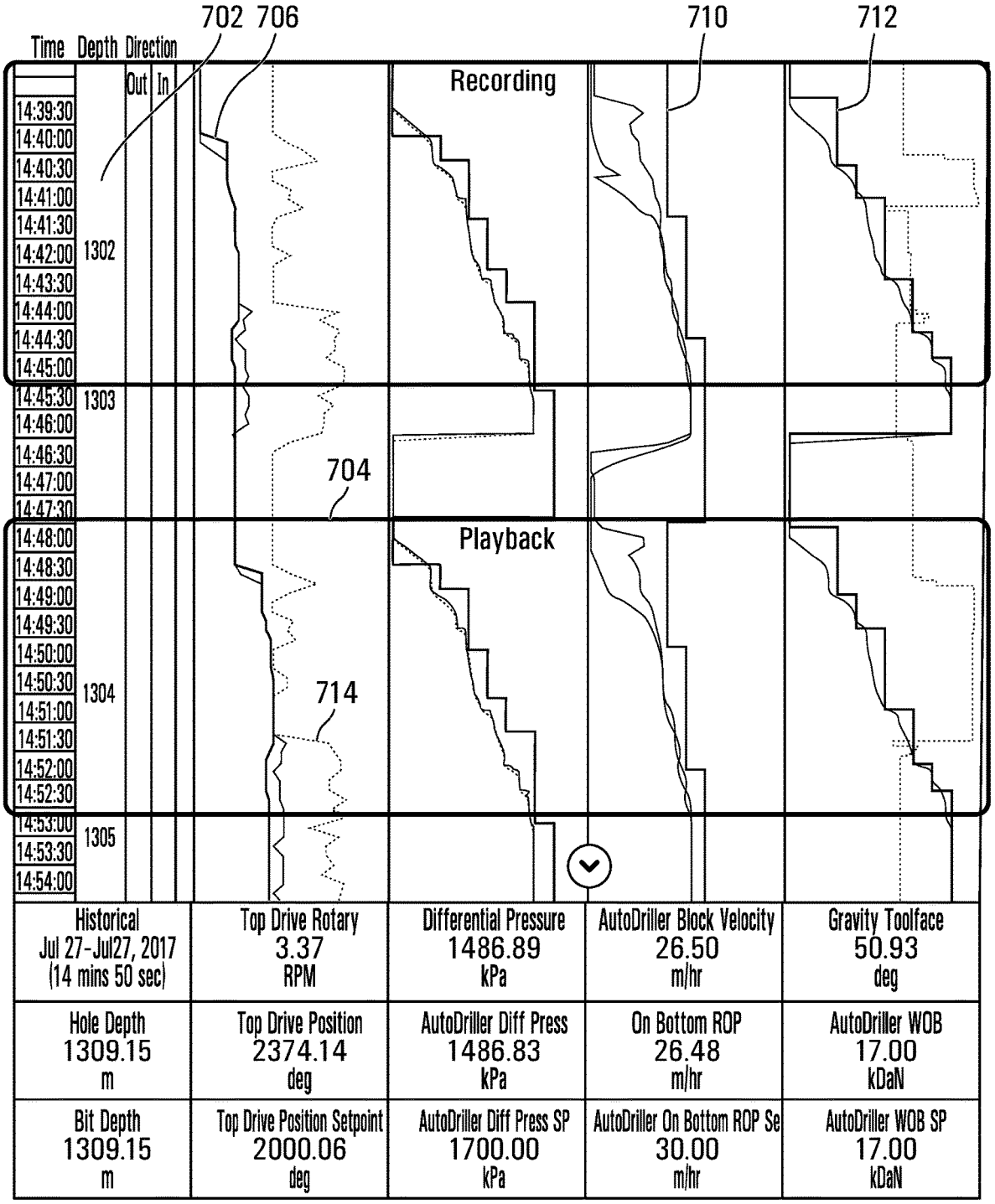
FIG. 7 depicts traces of controlled drilling parameters during a recording phase and a playback phase.

Turning to FIG. 7, there is shown a graphical user interface depicting variations in drilling parameters in a recording phase and a playback phase, corresponding to a slide, and using the data from FIG. 5. As can be surmised, the traces during the playback phase largely mirror the traces during the recording phase, indicative of the automatic driller 206 using the recording phase data to adjust the controlled drilling parameter setpoints during the playback phase. The drilling parameter used as the index (i.e. the controlling drilling parameter) is bit depth 702, shown on the left of the graph. In other embodiments, controlling drilling parameters such as time 704, differential pressure, and toolface positon could be used instead of/in combination with bit depth in order to index the controlled drilling parameters. The controlled drilling parameters represented by the traces are top drive SP 706, differential pressure SP 708, ROP SP 710, WoB SP 712, and Top Drive Rotary 714.

Turning to FIG. 8, there is shown an example recording of drilling parameters obtained during a recording phase, in a similar fashion to the FIG. 5 recording. However, while FIG. 5 relates to a recording obtained during a slide, FIG. 8 relates to a recording obtained during rotary drilling.

Figure 9:
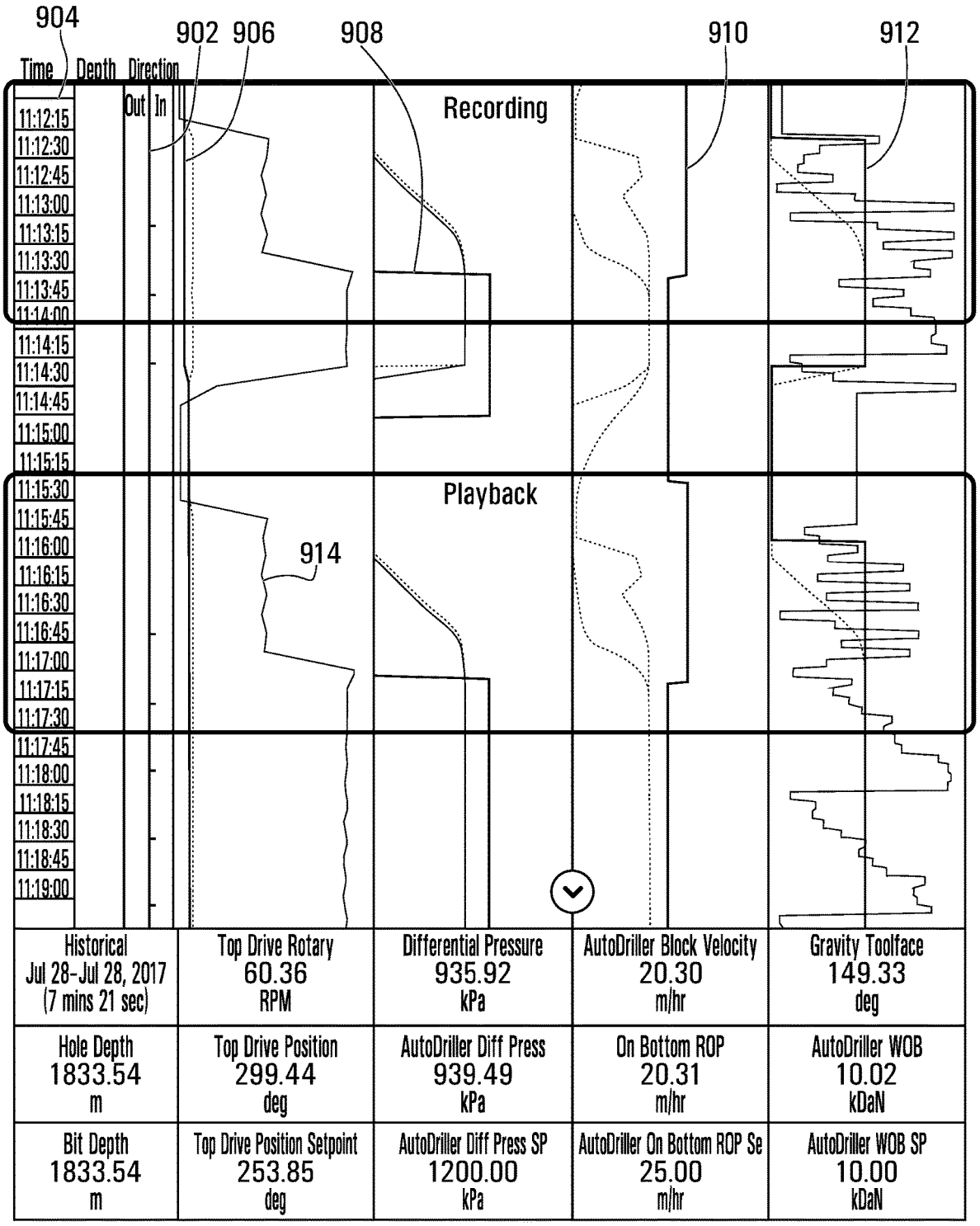
FIG. 9 depicts traces of controlled drilling parameters during a recording phase and a playback phase.

FIG. 9 shows the corresponding graphical user interface depicting variations in drilling parameters in a recording phase and a playback phase, using the data from FIG. 8. Like reference numerals are used to identify the controlled drilling parameters.

Figure 10:
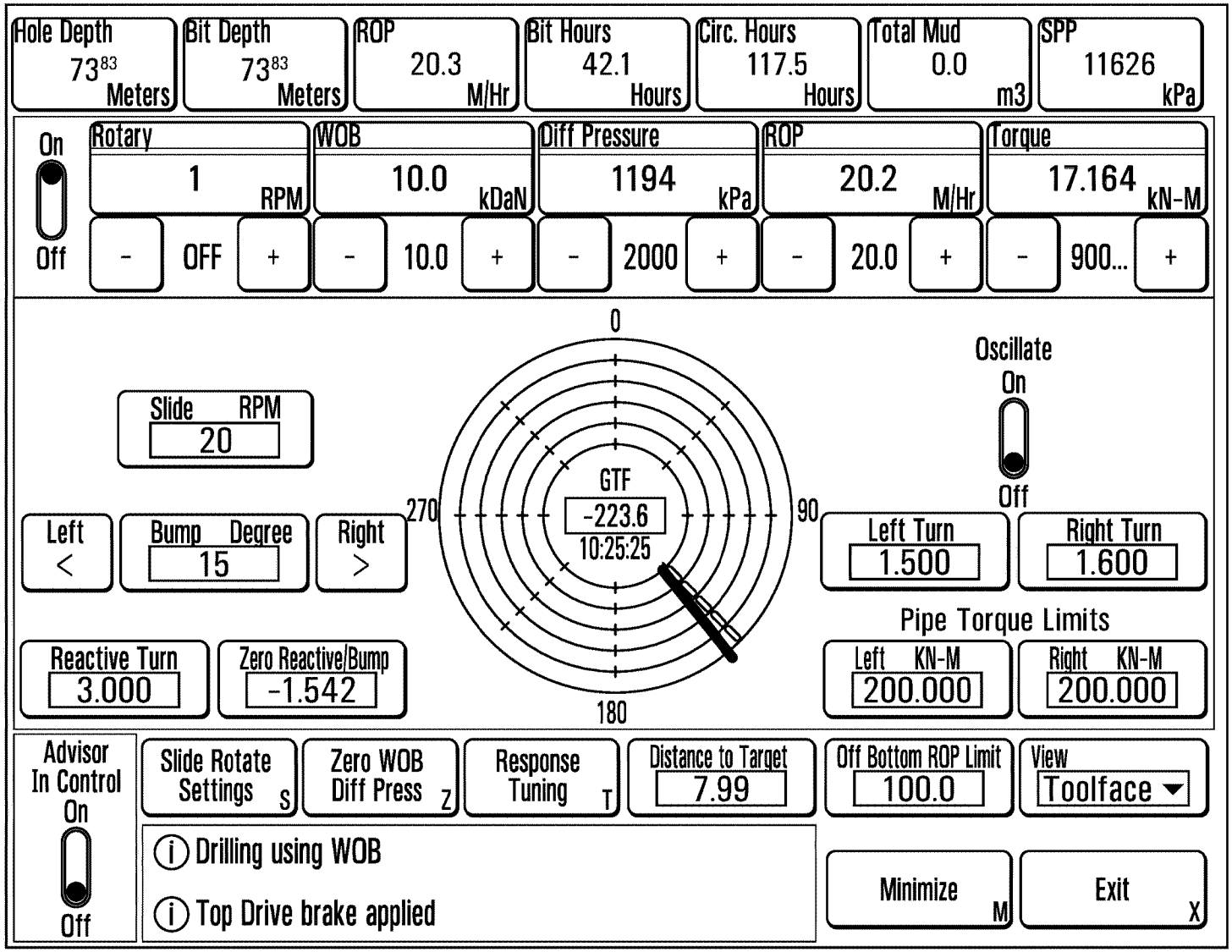
FIG. 10 depicts a graphical user interface of a system for automatically controlling a drilling operation, according to an example embodiment of the disclosure.

FIG. 10 shows an example graphical user interface that may be used by the drilling operator during the first and second drilling operations.

In some embodiments, the recording phase is not necessarily carried out by the automatic driller 206. For example, a recording of controlled drilling parameters vs. controlling drilling parameters may be obtained by some device external to the automatic driller 206, and the recording may then be received at the automatic driller 206 for subsequent use.

In some embodiments, for example at block 604 in FIG. 6, the automatic driller 206 may record an initial state of the drill bit, the quill, and/or the drill string. This may include recording initial values for the block position, top position and toolface angle, as well as all other controlled parameter setpoints. The initial state may correspond to one or more initial controlled drilling parameters. Furthermore, the initial state may comprise absolute values, or offsets, corresponding to the one or more initial controlled drilling parameters. For example, the automatic driller 206 may obtain readings from the sensors 216, 218, 220, 222, 224, 230 and 232, the readings corresponding to initial drilling parameters. Prior to carrying out the playback phase, the automatic driller 206 may then pre-adjust the controlled drilling parameters by using the recording of the initial drilling parameters. In particular, the controlled drilling parameters may be adjusted to match the initial drilling parameters of the initial state of the drill bit. Thus, for example, during system initialization, the toolface angle may be set to the same initial toolface angle at the start of the recording, or else changed to a specific starting toolface angle as requested by the drilling operator.

In some embodiments, the drilling operator may intervene during the playback phase and may manually adjust the controlled drilling parameter setpoints by providing some user input to the automatic driller 206. The automatic driller 206 may be configured to cease further adjustment of the controlled drilling parameters should the operator intervene in such a manner.

Furthermore, the drilling operator may modify a previous recording by providing user input to the automatic driller 206. The modified recording may then be used as the basis for subsequent playback operations. Furthermore, as mentioned above, the recording phase may overlap with the playback phase, and may run in parallel to the playback phase. Manual interventions during the playback phase may thus be recorded by the automatic driller 206, and the recording of the playback phase (including any adjustments made by the operator) may effectively form a new recording that may in turn be used for subsequent playback operations. Thus, a library of recordings may effectively be generated for different drilling scenarios. Any modifications to a recording (either before, during or after playback) may be saved together with the playback and may form the basis of a new recording.

Furthermore, the operator may select one or more portions of a recording for playback, independently of non-selected portions. This may be particularly useful when time is used as the controlling parameter. For example, assume that, during a playback phase, the actions of the automatic driller 206 (and any manual interventions by the operator) are recorded and span a 30-minute interval. During a later drilling operation, the operator may consider the first 10 minutes and the last 10 minutes of the recording to be particularly useful. The drilling operator may then select these two "windows" for playback, which is then implemented by the automatic driller 206.

In some embodiments, the index that is used during the playback phase may be changed, for example in response to user input. For instance, whereas the discussion of FIG. 6 above uses bit depth as an example index, during the playback phase the automatic driller 206 may switch to adjusting the controlled drilling parameter setpoints as a function of some other index, such as toolface angle or differential pressure.

While the drilling operations have been discussed largely in the context of directional drilling operations, the described methods for automatically controlling a drilling operation may be employed during rotary and sliding drilling, among others, and furthermore when the drill string is being withdrawn from a wellbore (e.g. during reaming).

As will be understood by the skilled person, any number and type of suitable drilling parameter may be adjusted using the methods and systems described herein, by implementing one or more sensors configured to monitor such drilling parameters. Therefore, the fact that FIG. 2 shows seven different types of sensors should not be construed as limiting, since the system described herein may include other sensors for monitoring other drilling parameters not explicitly taught in the disclosure.

While the disclosure has been described in connection with specific embodiments, it is to be understood that the disclosure is not limited to these embodiments, and that alterations, modifications, and variations of these embodiments may be carried out by the skilled person without departing from the scope of the disclosure. It is furthermore contemplated that any part of any aspect or embodiment discussed in this specification can be implemented or combined with any part of any other aspect or embodiment discussed in this specification.

What is claimed is:

1. A method for automatically controlling a drilling operation, comprising:

obtaining a recording of one or more controlled drilling parameters adjusted, during a first drilling operation, in response to one or more controlling drilling parameters; and during a second drilling operation subsequent to the first drilling operation:

monitoring the one or more controlling drilling parameters; and automatically adjusting the one or more controlled drilling parameters in response to the monitored one or more controlling drilling parameters by using the recording of the one or more controlled drilling parameters.

2. The method of claim 1, wherein obtaining the recording comprises:

during the first drilling operation:

adjusting the one or more controlled drilling parameters in response to the one or more controlling drilling parameters; and recording the one or more controlled drilling parameters as a function of the one or more controlling drilling parameters.

3. The method of claim 1, further comprising:

obtaining a recording of an initial state of a drill bit prior to the first drilling operation, wherein the initial state corresponds to one or more initial controlled drilling parameters; and adjusting the one or more controlled drilling parameters using the recording of the initial state of the drill bit prior to automatically adjusting the one or more controlled drilling parameters.

4. The method of claim 1, further comprising:

during the second drilling operation, ceasing further automatic adjustment of the one or more controlled drilling parameters in response to a user input.

5. The method of claim 1, further comprising:

during the automatic adjustment of the one or more controlled drilling parameters, further adjusting the one or more controlled drilling parameters in response to a user input.

6. The method of claim 5, further comprising:

recording, during the automatic adjustment, the one or more controlled drilling parameters as a function of the one or more controlling drilling parameters, thereby generating a user-adjusted recording.

7. The method of claim 6, further comprising, during a third drilling operation subsequent to the second drilling operation:

monitoring the one or more controlling drilling parameters; and automatically adjusting the one or more controlled drilling parameters in response to the monitored one or more controlling drilling parameters by using the user-adjusted recording.

8. The method of claim 1, wherein automatically adjusting the one or more controlled drilling parameters by using the recording of the one or more controlled drilling parameters comprises automatically adjusting the one or more controlled drilling parameters by playing back the recording of the one or more controlled drilling parameters adjusted in response to the one or more controlling drilling parameters.

9. The method of claim 1, wherein automatically adjusting the one or more controlled drilling parameters by using the recording of the one or more controlled drilling parameters comprises:

identifying in the recording:

one or more recorded controlling drilling parameters that correspond to a next recorded index; and one or more recorded controlled drilling parameters that correspond to the identified one or more recorded controlling drilling parameters; and adjusting the one or more controlled drilling parameters based on the identified one or more recorded controlled drilling parameters.

10. The method of claim 1, wherein one or more of:

the one or more controlled drilling parameters comprise one or more of:

a differential pressure, an on-bottom rate of penetration, an off-bottom rate of penetration, a toolface angle, a weight-on-bit, a torque, a rotary velocity of a drill bit, an amount of elapsed time, a top drive position, an oscillating status, a number of turns when oscillating, and a block height; and the one or more controlling drilling parameters comprise one or more of:

a differential pressure, an on-bottom rate of penetration, an off-bottom rate of penetration, a toolface angle, a weight-on-bit, a torque, a rotary velocity of a drill bit, an amount of elapsed time, a top drive position, an oscillating status, a number of turns when oscillating, and a block height.

11. A system for automatically controlling a drilling operation, comprising: one or more drilling parameter sensors for reading one or more controlling drilling parameters; and an automatic driller communicative coupled to each of the one or more drilling parameter sensors and configured to: obtain a recording of one or more controlled drilling parameters adjusted, during a first drilling operation, in response to the one or more controlling drilling parameters; and during a second drilling operation subsequent to the first drilling operation: monitor the one or more controlling drilling parameters; and automatically adjust the one or more controlled drilling parameters in response to the monitored one or more controlling drilling parameters by using the recording of the one or more controlled drilling parameters.

12. The system of claim 11, wherein the automatic driller is: further configured to: determine, during the first drilling operation, the one or more controlled drilling parameters from readings taken by the one or more drilling parameter sensors; and determine, during the first drilling operation, the one or more controlling drilling parameters from readings taken by the one or more drilling parameter sensors, so as to obtain the recording of the one or more controlling drilling parameters adjusted, during the first drilling operation, in response to the one or more controlling drilling parameters.

13. The system of claim 11, wherein the automatic driller is further configured to:

obtain a recording of an initial state of a drill bit prior to the first drilling operation, wherein the initial state corresponds to one or more initial controlled drilling parameters; and adjust the one or more controlled drilling parameters using the recording of the initial state of the drill bit prior to automatically adjusting the one or more controlled drilling parameters.

14. The system of claim 11, wherein the automatic driller is further configured to:

receive a user input; and further adjust the one or more controlled drilling parameters in response to the user input.

15. The system of claim 14, wherein the automatic driller is further configured to:

generate a user-adjusted recording by recording, during the automatic adjustment, the one or more controlled drilling parameters as a function of the one or more controlling drilling parameters.

16. The system of claim 15, wherein the automatic driller is further configured to:

monitor the one or more controlling drilling parameters; and automatically adjust the one or more controlled drilling parameters in response to the monitored one or more controlling drilling parameters by using the user-adjusted recording.

17. The system of claim 11, wherein the automatic driller is further configured to:

receive a user input; and cease further automatic adjustment of the one or more controlled drilling parameters in response to the user input.

18. The system of claim 11, wherein the automatic driller is further configured to automatically adjust the one or more controlled drilling parameters by playing back the recording of the one or more controlled drilling parameters adjusted in response to the one or more controlling drilling parameters.

19. The system of claim 11, wherein the automatic driller is further configured to:

identify in the recording:

one or more recorded controlling drilling parameters that correspond to a next recorded index; and one or more recorded controlled drilling parameters that correspond to the identified one or more recorded controlling drilling parameters; and adjust the one or more controlled drilling parameters based on the identified one or more recorded controlled drilling parameters.

20. The system of claim 11, wherein one or more of:

the one or more controlled drilling parameters comprise one or more of:

a differential pressure, an on-bottom rate of penetration, an off-bottom rate of penetration, a toolface angle, a weight-on-bit, a torque, a rotary velocity of a drill bit, an amount of elapsed time, a top drive position, an oscillating status, a number of turns when oscillating, and a block height; and the one or more controlling drilling parameters comprise one or more of:

a differential pressure, an on-bottom rate of penetration, an off-bottom rate of penetration, a toolface angle, a weight-on-bit, a torque, a rotary velocity of a drill bit, an amount of elapsed time, a top drive position, an oscillating status, a number of turns when oscillating, and a block height.

21. A non-transitory computer-readable medium having computer program code stored thereon, the computer program code configured, when executed by a computer, to cause the computer to carry out a method comprising:

accessing a recording of one or more controlled drilling parameters adjusted, during a first drilling operation, in response to one or more controlling drilling parameters; and during a second drilling operation subsequent to the first drilling operation:

monitoring the one or more controlling drilling parameters; and automatically adjusting the one or more controlled drilling parameters in response to the monitored one or more controlling drilling parameters by using the recording of the one or more controlled drilling parameters.

22. The computer-readable medium of claim 21, wherein accessing the recording comprises:

during the first drilling operation:

adjusting the one or more controlled drilling parameters in response to the one or more controlling drilling parameters; and recording the one or more controlled drilling parameters as a function of the one or more controlling drilling parameters.

23. The computer-readable medium of claim 21, wherein the method further comprises:

accessing a recording of an initial state of a drill bit prior to the first drilling operation, wherein the initial state corresponds to one or more initial controlled drilling parameters; and adjusting the one or more controlled drilling parameters using the recording of the initial state of the drill bit prior to automatically adjusting the one or more controlled drilling parameters.

24. The computer-readable medium of claim 21, wherein the method further comprises:

during the second drilling operation, ceasing further automatic adjustment of the one or more controlled drilling parameters in response to a user input.

25. The computer-readable medium of claim 21, wherein the method further comprises:

during the automatic adjustment of the one or more controlled drilling parameters, further adjusting the one or more controlled drilling parameters in response to a user input.

26. The computer-readable medium of claim 21, wherein the method further comprises:

receiving a selection of one or more portions of the recording, wherein the one or more portions comprise one or more ranges of the one or more controlling drilling parameters; and automatically adjusting the one or more controlled drilling parameters in response to the monitored one or more controlling drilling parameters by using the one or more selected portions of the recording.

27. The computer-readable medium of claim 21, wherein automatically adjusting the one or more controlled drilling parameters by using the recording of the one or more controlled drilling parameters comprises automatically adjusting the one or more controlled drilling parameters by playing back the recording of the one or more controlled drilling parameters adjusted in response to the one or more controlling drilling parameters.

28. The computer-readable medium of claim 21, wherein automatically adjusting the one or more controlled drilling parameters by using the recording of the one or more controlled drilling parameters comprises:

identifying in the recording:

one or more recorded controlling drilling parameters that correspond to a next recorded index; and one or more recorded controlled drilling parameters that correspond to the identified one or more recorded controlling drilling parameters; and adjusting the one or more controlled drilling parameters based on the identified one or more recorded controlled drilling parameters.

29. The computer-readable medium of claim 21, wherein one or more of:

the one or more controlled drilling parameters comprise one or more of:

a differential pressure, an on-bottom rate of penetration, an off-bottom rate of penetration, a toolface angle, a weight-on-bit, a torque, a rotary velocity of a drill bit, an amount of elapsed time, a top drive position, an oscillating status, a number of turns when oscillating, and a block height; and the one or more controlling drilling parameters comprise one or more of:

a differential pressure, an on-bottom rate of penetration, an off-bottom rate of penetration, a toolface angle, a weight-on-bit, a torque, a rotary velocity of a drill bit, an amount of elapsed time, a top drive position, an oscillating status, a number of turns when oscillating, and a block height.

* * * * *